US005498055A

United States Patent [19]

Goldman

[11] Patent Number: 5,498,055

[45] Date of Patent: Mar. 12, 1996

[54] RECLINER: APPARATUS AND METHOD

[76] Inventor: Paul R. Goldman, 8 Joyce Ter., Andover, Mass. 01810

[21] Appl. No.: 153,665

[22] Filed: Nov. 16, 1993

[51] Int. Cl.[6] ..... A47C 1/035

[52] U.S. Cl. ..... 297/68; 297/282; 297/301.2; 297/301.7; 297/362.13

[58] Field of Search ..... 297/68, 83, 84, 297/88, 281, 282, 273, 362.13, 375, 301.1, 301.2, 301.7

[56] References Cited

U.S. PATENT DOCUMENTS

| | | | |
|---|---|---|---|
| 93,660 | 8/1869 | Theaker | 297/327 |
| 463,863 | 11/1891 | Johnson | 297/282 X |
| 825,984 | 7/1906 | Schmersahl | 297/282 |
| 2,227,597 | 1/1941 | Luckhardt et al. | 297/83 |
| 2,948,330 | 8/1960 | Lorenz | 297/83 |
| 3,235,304 | 6/1964 | Glass | 297/282 |
| 4,092,041 | 5/1978 | Landry et al. | 297/271 |
| 4,341,420 | 7/1982 | Knowles et al. | 297/281 X |
| 4,572,573 | 2/1986 | Yoshikawa et al. | 297/83 X |
| 4,790,599 | 12/1988 | Goldman | 297/282 X |
| 4,877,291 | 10/1989 | Taylor | 297/322 X |

FOREIGN PATENT DOCUMENTS

| | | | |
|---|---|---|---|
| 526914 | 3/1954 | Belgium | 297/328 |

*Primary Examiner*—Peter R. Brown
*Attorney, Agent, or Firm*—Fish & Richardson

[57] ABSTRACT

A recliner apparatus and method allows an occupant to recline with his feet elevated above his heart. The recliner has a chair structure composed of seat, back and footrest portions, that are supported by two side members of a frame structure. An adjustment device under the seat elevates the footrest in response to a downward rotation of the back relative to the seat. The chair structure may be rotated with respect to the frame structure by means of an elevated pivot structure attached to the side members of the frame.

13 Claims, 5 Drawing Sheets

RECLINER: APPARATUS AND METHOD

BACKGROUND OF THE INVENTION

The invention relates generally to furniture and, in particular, to a new recliner apparatus and method for raising the feet of an individual occupying a recliner above the level of his heart.

Recliners have been manufactured by the furniture industry for hundreds of years. For example, the rocking chair acts in part as a recliner and allows its occupant to lean back, or to rock back and forth, around a moving pivot point close to the floor. Many other recliners provide a footrest which pivots upward as the recliner back moves down, leaving the occupant in a substantially supine position.

A new type of recliner raises an occupant's feet above the level of his heart from a fixed semi-reclined position. As described in U.S. Pat. No. 4,790,599, the recliner has a chair structure that swings around an axis defined by two pivot points on either side of a supporting frame structure. The components of the chair structure, e.g. back, seat and footrest, remain fixed relative to one another as the chair structure pivots. Thus the entire chair structure swings, but the chair structure itself does not recline.

Objects of the present invention are a recliner apparatus and method in which, in a fully reclined position, the feet of an occupant are raised above his heart. The recliner is simple to manufacture, of reliable construction, and comfortable to the occupant.

SUMMARY OF THE INVENTION

A recliner, according to the invention, called a Swingliner, has a frame and a chair structure composed of a back, seat and footrest. The recliner is capable of two types of motion: the chair structure can rotate relative to the frame structure; and the footrest and back may pivot relative to the seat. Thus the chair structure both swings and reclines. The two types of rotation allow the recliner to go from an upright to a fully reclined position in which the feet of an occupant of the recliner are raised above the level of his heart.

The chair structure rotates relative to the frame structure by means of two pivots on either side of the frame. The sides of the frame support, from the pivot points, the weight of the seat and any occupant of the recliner.

The portions of the chair structure rotate relative to one another by means of connecting pivots. As the back of the chair pivots downward relative to the seat, an adjustment device located under the seat moves the footrest up. The adjustment device has a set of rigid connecting members that connect the back, seat and footrest portions of the chair structure, and additional elements for providing stability, for example, a slide track or a pneumatic cylinder.

BRIEF DESCRIPTION OF THE DRAWINGS

Other objects, features, and advantages of the invention will appear from the following description of a preferred embodiment, taken together with the drawings in which.

DESCRIPTION OF THE PREFERRED EMBODIMENTS

Figure 1:
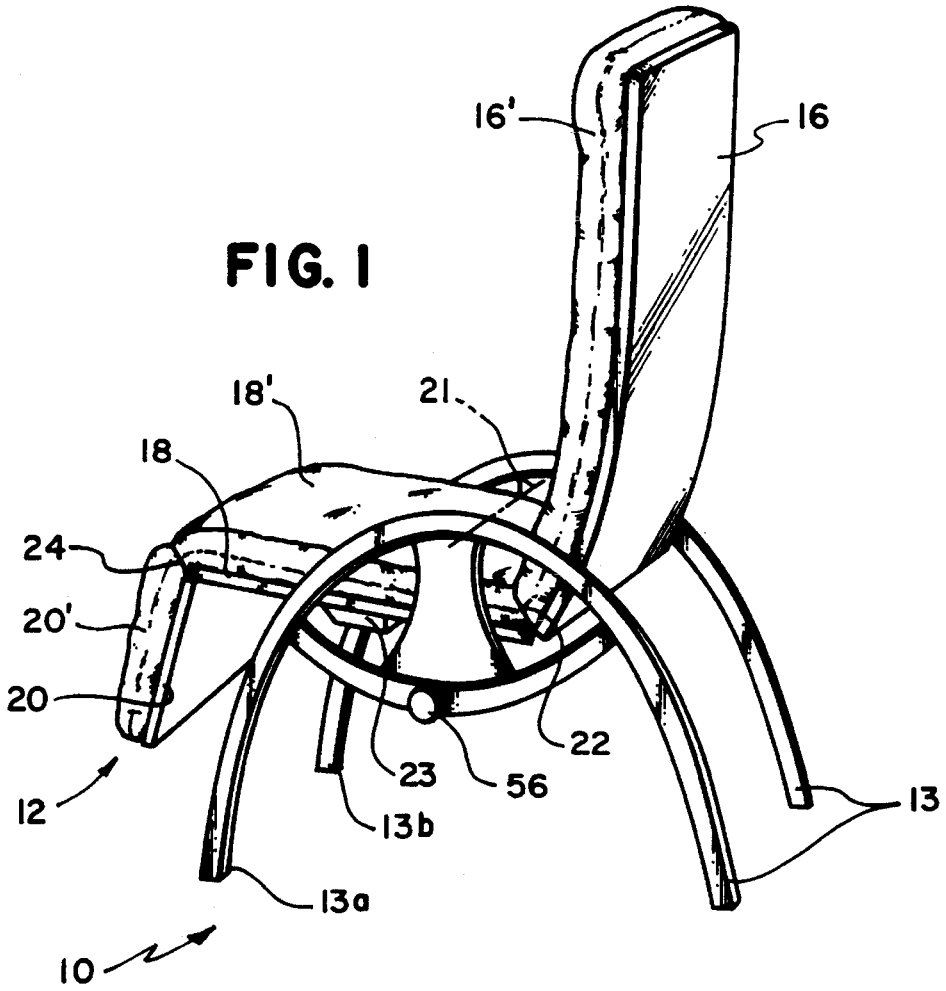
FIG. 1 is a perspective view of a recliner according to the invention.

Referring to FIG. 1, a recliner 10 has a chair structure 12 and a frame 13, with side members 13*a*, 13*b*. The chair structure has a back portion 16, a seat portion 18, and a footrest portion 20. Each portion of the chair structure, in the illustrated embodiment, is covered with a canvas material, laced at an open end of each section, over which are placed cushioned back section 16', seat section 18' and footrest section 20'. The cushioned sections can be attached to the canvas using, for example, Velcro fasteners.

The chair structure is reclined using two types of pivoting motion. In a first type of motion, the entire chair structure 12 pivots about an axis 21, connecting the two side members of the frame. In a second type of motion, the seat and back portions pivot around their line of junction 22 independently of one another. An adjustment device 23 located under the seat pivots the footrest about its line of junction 24 with the seat in response to a rotation of the back relative to the seat.

Figure 2:
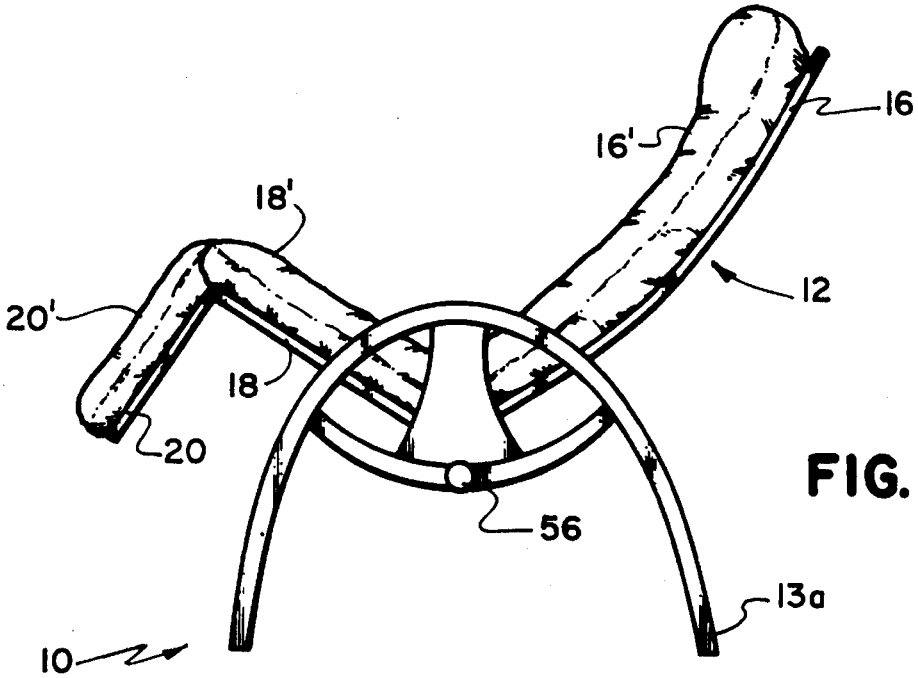
FIG. 2 is a side view of the recliner in a swung back, but not reclined, position.
Figure 3:
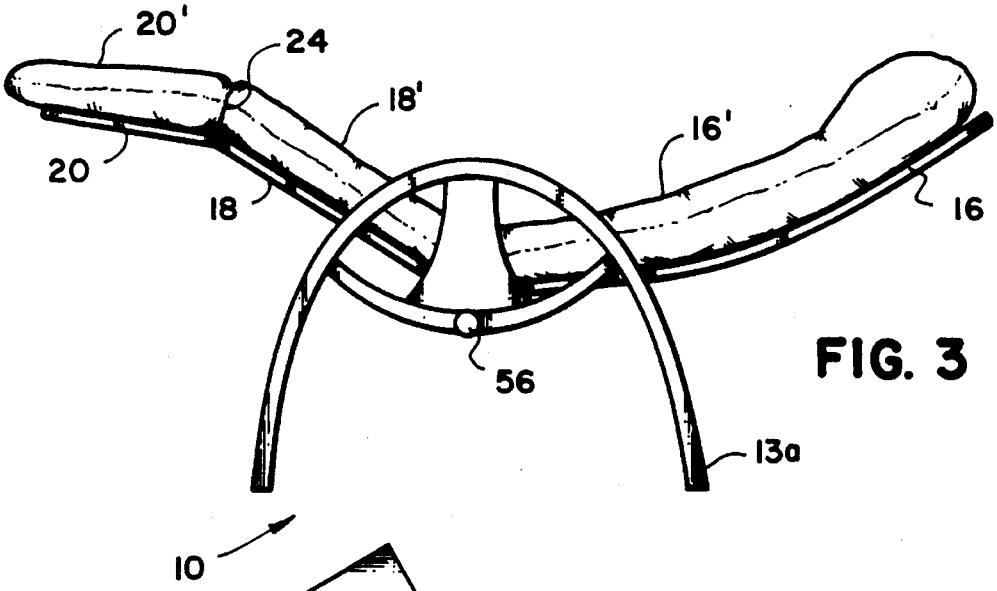
FIG. 3 is a side view of the recliner in a fully reclined position.

The two types of pivot motion allow the chair structure to take on a variety of reclined positions. For example, in FIG. 1, the chair is in a fully upright position. In FIG. 2, the chair structure 12 has been pivoted about axis 21, while the relative positions of the back, seat and footrest portions have remained fixed. In FIG. 3, the chair structure has been further rotated about axis 21 from its position in FIG. 2. In addition, the back portion 16 has been pivoted about its line of junction to the seat portion 18. The footrest portion 20 has rotated upwards about its line of junction 24 to the seat in response to the rotation of the back relative to the seat. The recliner is now in a fully reclined position, where an occupant's feet would be raised above his heart.

Figure 4:
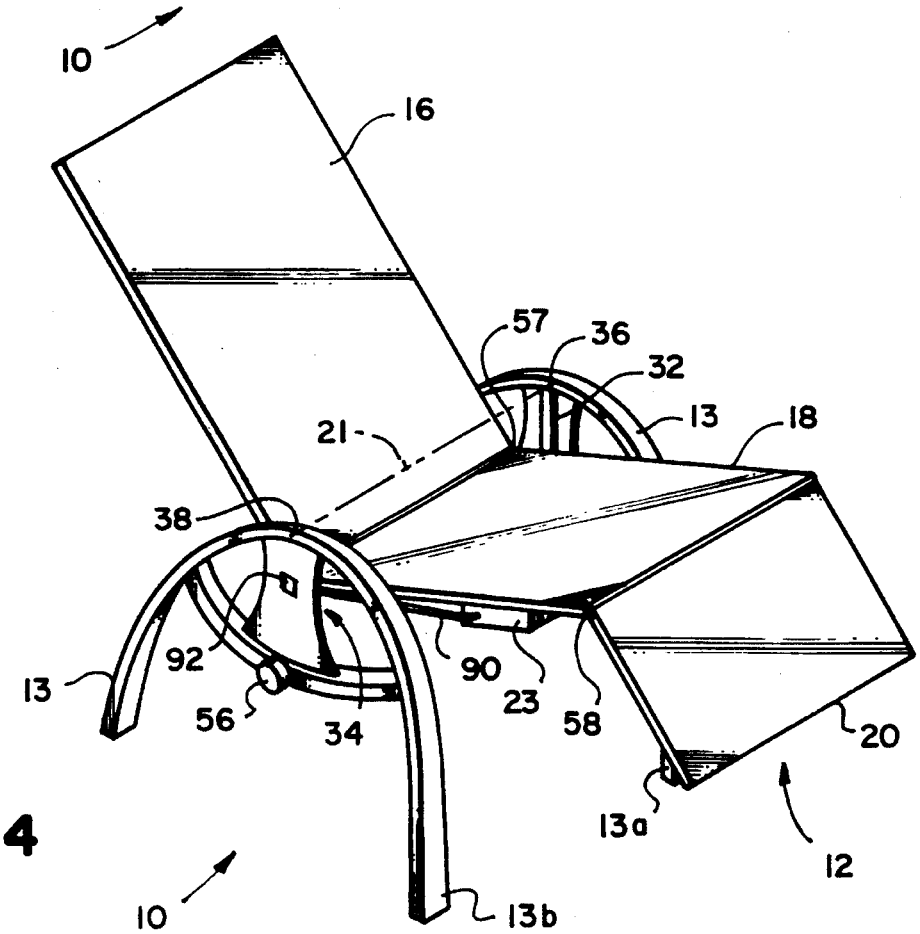
FIG. 4 is a perspective view of the recliner wherein its construction details can be more clearly understood.

As shown in FIG. 4, the entire chair structure 12 rotates by means of pivot structures 32, 34 that are pivotally connected to side members 13*a* and 13*b* at pivot pins 36, 38, respectively. The pivot structures fully support the weight of the chair structure and any occupant of the recliner. The chair structure can thus swing about axis 21 connecting pivot pins 36, 38.

Figure 5:
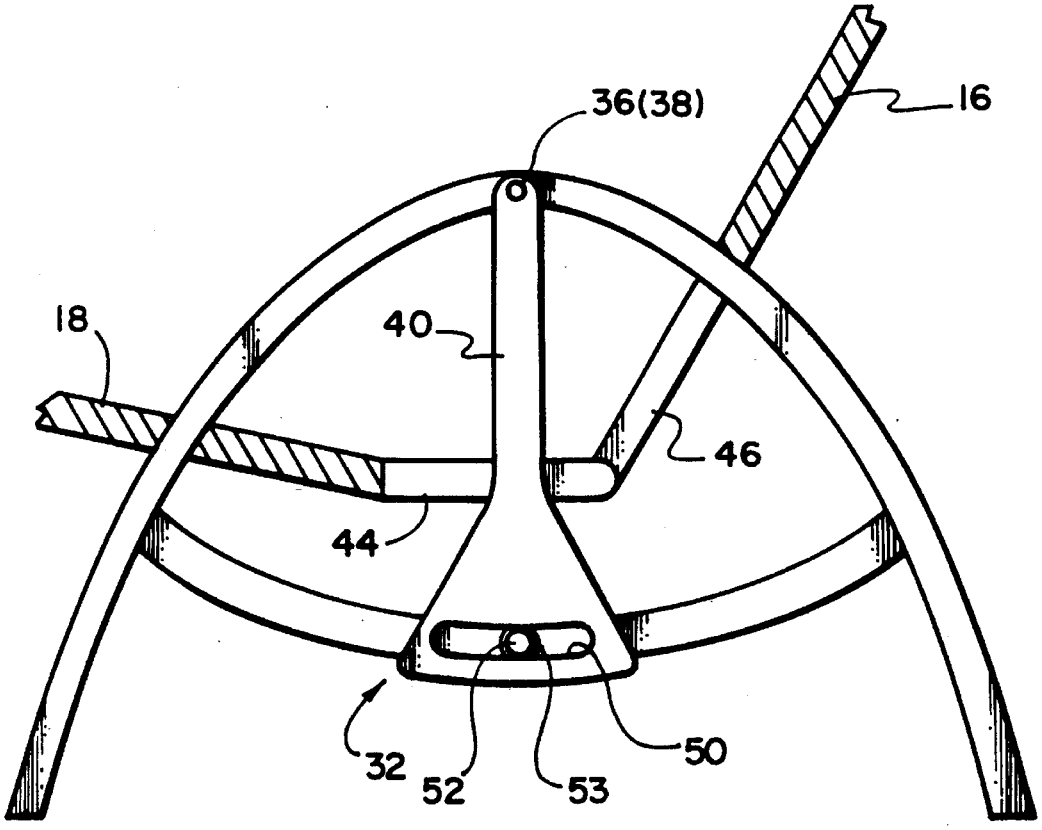
FIG. 5 is a partially cut-away side view of the frame and pivot structure of the recliner of FIG. 1.

Each pivot structure 32 (34), shown in FIG. 5, is composed of a bar member 40 extending from a pivot pin 36 (38) on each side member 13*a* (13*b*), and is welded to support plate 44. Support plate 44 is bolted to the seat portion 18 and is connected to support plate 46 is attached to the back portion 16. The support plates are preferably constructed of heavy gauge plate steel, for example, eleven gauge.

To ensure a stable rotation, the ends of the bar members 40 have a guide track 50. A rod member or bolt 52 is fixed to the frame side member and passes through the guide track. Spacer elements 53, such as leather washers, provide the correct distancing between the bar 40 and guide track 50. A threaded knob 56 is attached to the bolt on the outside of the side member, as shown in FIG. 1. Knob 56 can be tightened to hold the chair structure at a selected reclined position.

Returning to FIG. 4, the relative motion of the chair portions is made possible by hinges 57, 58 which attach the back to the seat, and the footrest to the seat, respectively. Hinges 57, 58 define junctions 22, 24 respectively.

Figure 6:
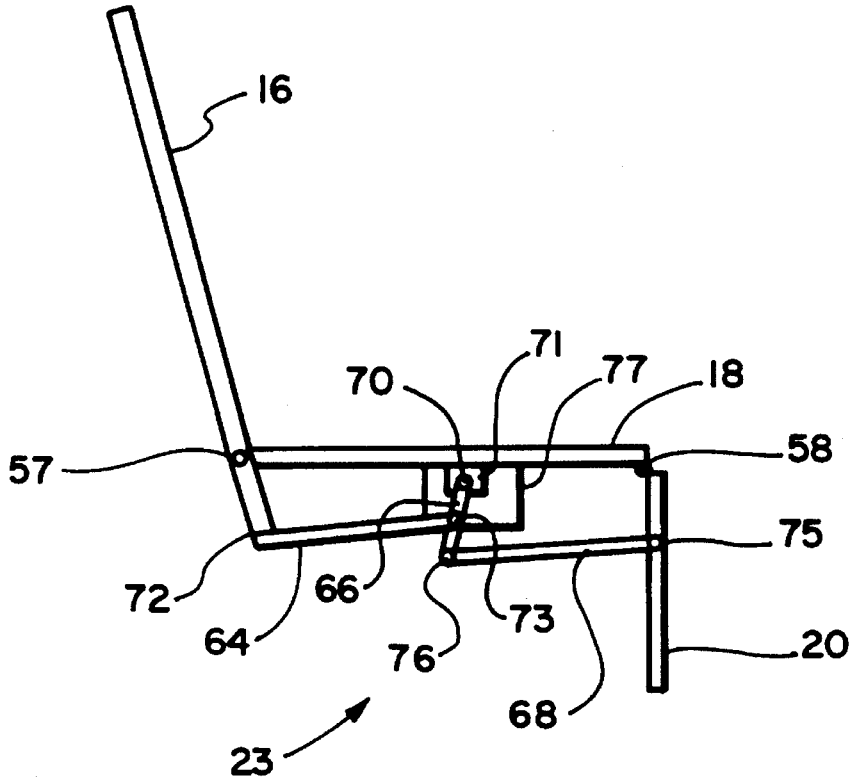
FIGS. 6 and 7 are partial side views of the recliner in an upright, and reclined position, respectively.

The adjustment device 23 automatically moves the footrest about its hinge 58, in response to a rotation of the back portion 16 relative to the seat portion 18. As shown in FIG. 6, the adjustment device has three bar members or posts 64, 66, 68, that may be made of metal, plastic, or any suitably strong material. Post 66 is free to rotate about a pivot axis 70, and connects to the seat portion at pivot axis 70 using a pivoting connector structure 71. One end of post 64 is bolted for pivoting movement to underside 72 of the back, and its other end is bolted, again for pivoting movement, to the second post 66 at a junction 73. Post 68 is connected to the footrest 20 at one end, for pivoting movement, at a junction 75; its other end is attached to post 66, for pivoting movement, at a junction 76. The adjustment device 23 also contains a resistive component 77, which is discussed below in connection with FIGS. 8 and 9.

Figure 7:
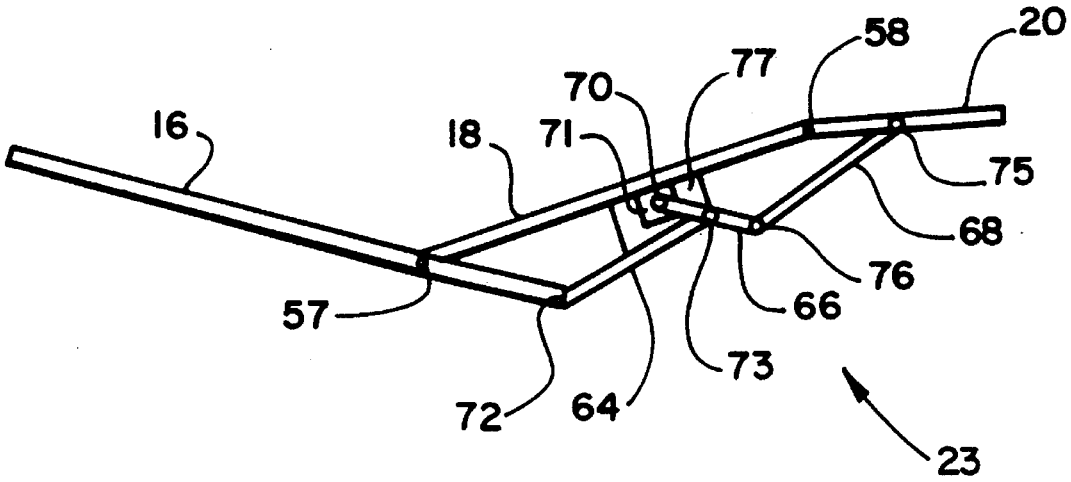

As the back portion 16 of the chair structure pivots downward, post 64 moves to the right in FIG. 6, forcing post 66 to rotate counterclockwise about its pivot axis 70. The rotation of post 66 pushes post 68 outward, elevating the footrest portion. The resulting reclined position is shown in FIG. 7.

Figure 8:
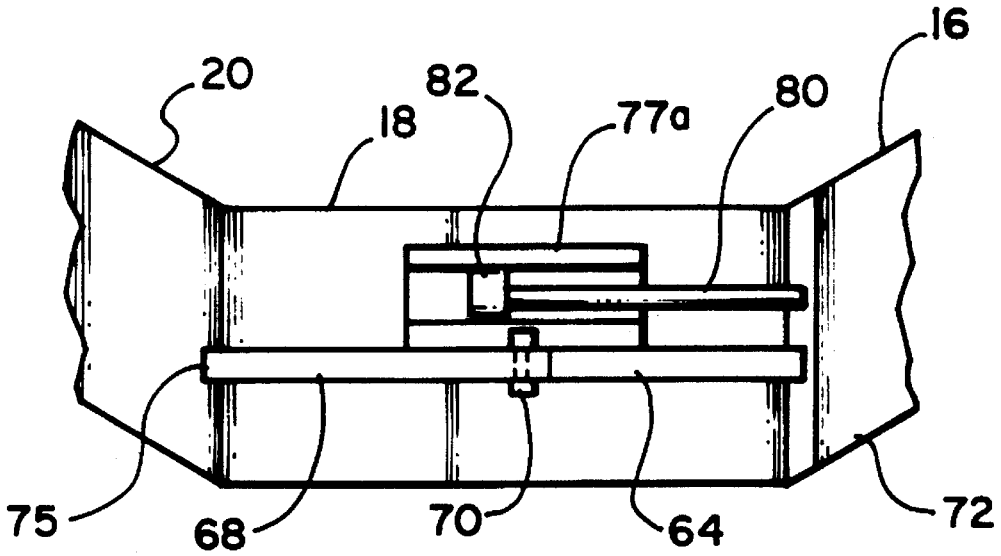
FIGS. 8 and 9 are schematic bottom views of the recliner in accordance with a preferred embodiment of the invention.
Figure 9:
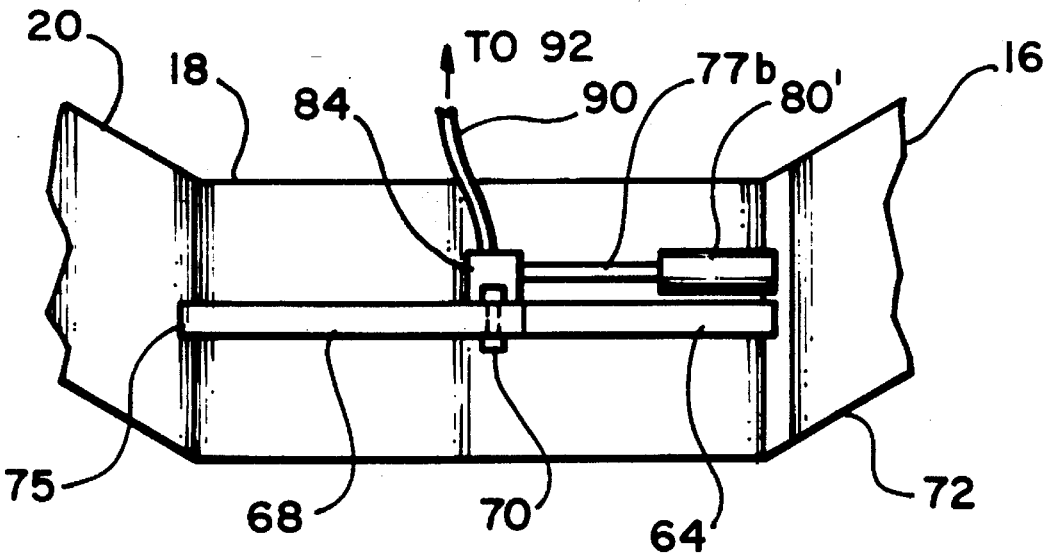

FIGS. 8 and 9 show two alternate embodiments of resistive component 77, a slide track 77*a* and a pneumatic plunger 77*b*, respectively, that improve the stability of the reclining mechanism. Referring to FIG. 8, an additional rod member 80, pivotally bolted to the underside 72 of the back portion 16, is oriented for movement in a plane parallel to the plane of movement of post 64. A slide 82 is attached to the free end of rod member 80. The slide 82 fits inside a slide track 77*a*, which is fixed to the underside of the seat portion 18. As the back portion 16 of the seat structure pivots, both posts 64 and 80 are pushed forward simultaneously, and the slide slides along the track. The track resists any translational motion of the free end of post 80 along the track, forcing a slower, more controlled extension of the chair.

Alternatively, and preferably, a pneumatic cylinder replaces post 80. In FIG. 9, a pneumatic cylinder 80' is pivotally connected to the underside 72 of the back portion 16, for movement parallel to the plane of movement of the post 64. The pneumatic cylinder is a model B-O-L 86409 available from Stabilus Co., Colmar, Pa. A plunger 77*b* is fixed to the underside of seat portion 18 at 84. As the back portion pivots downward relative to the seat portion, the cylinder 80' is pushed forward, and the plunger moves into the cylinder. The cylinder guides and controls the motion of the plunger, analogously to the slide track 77*a* guiding the slide 82.

For additional stability, a wire release 90 is connected from the plunger to a button 92 on side member 13*a*, shown in FIG. 4. In order to move the back portion relative to the seat portion, according to this illustrated embodiment, an occupant must manually release button 92. This action opens or unseals the pneumatic cylinder allowing movement of the plunger in the cylinder. When an occupant wishes to lock the back in position, he can release button 92, thus sealing the cylinder.

Additions, subtractions, deletions, and other modifications of the described embodiment of the invention will be apparent to those skilled in the art and are within the scope of the following claims.

What is claimed is:

1. A swinging recliner structure, comprising a frame structure, having a first and second side member, a connector for pivotally connecting a chair structure to said frame structure for swinging movement, said chair structure having a back portion, a footrest, a seat portion connected between said back portion and said footrest such that said footrest may pivot relative to said seat portion and said back portion may pivot relative to said seat portion, and an adjustment device attached to said back portion, said seat portion, and said footrest and comprising an assembly having one end coupled to said back portion and another end coupled to said footrest, said assembly being responsive to the pivoting of said back portion from an upright sitting position to a maximum fully reclined position, for effecting movement of said footrest from a fully tucked-in position to an extended position, whereby in the fully reclined position of said chair structure, the feet of an occupant of the recliner can be positioned above an occupant's heart, a rigid guide member attached to an underside of said seat;

a rigid member having one end coupled to said back portion and another end coupled to said guide member, said rigid member being adapted to move in a plane generally parallel to the assembly when an occupant pivots the back portion with respect to said seat portion, said guide member resisting movement of the rigid member to cause said back portion to pivot in a controlled fashion.

2. The recliner of claim 1, wherein said assembly comprises a first rigid connecting member, having one end pivotally attached to said back portion, and another end pivotally attached to a second rigid connecting member between the two ends of the second rigid connecting member, said second rigid connecting member having one end pivotally attached to said seat portion, and another end pivotally attached to one end of a third rigid connecting member, said third rigid connecting member having its other end pivotally attached to said footrest, so that, as said back portion pivots downward, said third rigid connecting member moves forward relative to said seat portion, causing said footrest to elevate.

3. The recliner of claim 1, wherein said guide member comprises a resistive slide track attached to the underside of said seat portion of said chair structure, said adjustment device further comprising a slide member connected to one end of said rigid member, said slide member being configured to fit inside said resistive slide track, so that, as said back portion pivots, said slide member slides in said slide track.

4. The recliner of claim 1, wherein said rigid member comprises a plunger coupled to said back portion of said chair structure at one end, said guide member comprising a pneumatic cylinder connected to said seat portion of said chair structure, said plunger configured to fit inside said pneumatic cylinder, so that, as the back portion pivots, said plunger moves sealingly within said pneumatic cylinder to cause said chair structure to recline in a controlled manner.

5. The recliner of claim 4 wherein the adjustment device further comprises a switch coupled to said pneumatic cylinder for locking or unlocking the cylinder, the portions of the chair structure being fixed relative to one another when the cylinder is locked.

6. The recliner of claim 1, wherein said connector comprises bar members connected to said seat portion at a lower end and coupled at an upper end to a pivot connection on a side member of said frame structure, said side members supporting, from the pivot connection in each side member, the weight of the seat portion including the weight of any occupant of the chair structure, whereby said seat portion can swing beneath a pivot axis defined by the pivot connections of the first and second side members.

7. The recliner of claim 5 wherein each said bar member comprises on its lower end a guide track coupled to a side member of said frame structure by a rod member, said guide track sliding with respect to said rod member as the bar member pivots relative to the frame structure, said guide track providing stability to said recliner structure.

8. The recliner of claim 6 further comprising a seat positioning device for fixing the reclining position of said chair structure relative to said frame structure, the positioning device being connected to a bar member and a side member of the chair structure to fix said bar member relative to said side member.

9. The recliner of claim 6 wherein said guide track element has a slot for for receiving said rod member connected to said side member.

10. The recliner of claim 1, wherein said guide member comprises a plunger fixed to said seat portion, said rigid member comprising a pneumatic cylinder coupled to said back portion at one end and coupled to said plunger at an opposite end, said plunger being configured to fit inside said pneumatic cylinder, so that, as the back portion pivots, said plunger moves sealingly within said pneumatic cylinder to cause said chair structure to recline in a controlled manner.

11. The recliner of claim 10 wherein the adjustment device further comprises a switch coupled to said pneumatic cylinder for locking or unlocking the cylinder, the portions of the chair structure being fixed relative to one another when the cylinder is locked.

12. A method for constructing a recliner comprising the steps of forming a chair structure, composed of a back, seat and footrest portions, said seat portion being connected between said back and footrest portions such that said back and seat portions, and said seat and footrest portions are interdependently pivotable relative to one another, pivotally connecting the chair structure to a frame structure, effecting the interdependence by moving the footrest portion up as said back portion is pivoted downward, comprising coupling one end of an assembly to said back portion and another end to said footrest portion such that when said back portion is reclined with respect to said seat portion, a corresponding movement of the assembly causes said footrest to lift up;

attaching a rigid guide member to an underside of said seat portion;

coupling one end of a rigid member to said back portion and coupling another end to said guide member such that said rigid member moves in a plane generally parallel to the assembly when an occupant of the recliner reclines said back portion with respect to said seat portion, said guide member resisting movement of the rigid member to cause said back portion to recline in a stable fashion;

reclining said back portion relative to said seat portion; and pivoting the entire chair structure relative to the frame structure so that, in a most fully reclined position, the feet of an occupant can be positioned above the occupant's heart.

13. The method of claim 10, wherein the step of pivotally connecting said chair structure comprises supporting said seat portion by pivot connections on the frame structure.

* * * * *